US009573787B2

(12) United States Patent
Sperl et al.

(10) Patent No.: US 9,573,787 B2
(45) Date of Patent: Feb. 21, 2017

(54) GRIPPING DEVICE FOR GRIPPING SHEET MATERIAL

(71) Applicant: GIESECKE & DEVRIENT GMBH, Munich (DE)

(72) Inventors: Markus Sperl, Garching (DE); Erwin Demmeler, Memmingen (DE); Frank Werner, Munich (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 74 days.

(21) Appl. No.: 14/396,430

(22) PCT Filed: Apr. 22, 2013

(86) PCT No.: PCT/EP2013/001203
§ 371 (c)(1),
(2) Date: Oct. 23, 2014

(87) PCT Pub. No.: WO2013/159900
PCT Pub. Date: Oct. 31, 2013

(65) Prior Publication Data

US 2015/0093230 A1 Apr. 2, 2015

(30) Foreign Application Priority Data

Apr. 25, 2012 (DE) ..... 10 2012 008 242

(51) Int. Cl.
*B65H 31/30* (2006.01)
*B65G 61/00* (2006.01)

(52) U.S. Cl.
CPC ..... *B65H 31/3045* (2013.01); *B65H 2403/21* (2013.01); *B65H 2405/581* (2013.01);
(Continued)

(58) Field of Classification Search
CPC ..... B65H 2301/42242; B65H 31/3045; B65H 1/027; B65H 1/30; B25J 15/0253; B65G 47/90; Y10S 294/902; B65B 13/20
(Continued)

(56) References Cited

U.S. PATENT DOCUMENTS 4,162,804 A * 7/1979 Davies ..... B66C 1/48 294/101
4,247,092 A 1/1981 Dwyer
(Continued)

FOREIGN PATENT DOCUMENTS

DE 4401818 A1 7/1995
DE 102009042891 A1 3/2011
(Continued)

OTHER PUBLICATIONS

German Search Report for corresponding German Application No. 102012008242.8, Feb. 5, 2013.
(Continued)

*Primary Examiner* — Gregory Adams
(74) *Attorney, Agent, or Firm* — Workman Nydegger

(57) ABSTRACT

A gripping device for gripping a sheet-material stack has at least two gripping elements for gripping a sheet-material stack disposed between the gripping elements, which gripping elements can be moved toward each other in order to grip the sheet-material stack. At least one of the gripping fingers of one of the gripping elements is tiltable from its starting position, in which it is oriented substantially parallel to the stack surface, into a tilted position, in which it is inclined toward the stack surface. With the gripping device any types of sheet-material stacks can be reliably and trouble-free removed from a container and held against gravity through grip-clamping.

14 Claims, 5 Drawing Sheets

(52) U.S. Cl.
CPC ..... *B65H 2405/5812* (2013.01); *B65H 2513/512* (2013.01); *B65H 2515/31* (2013.01); *B65H 2701/1912* (2013.01)

(58) Field of Classification Search
USPC ..... 269/258; 294/103.1, 104, 119.1, 197, 294/207, 67.22, 907; 414/622, 67, 789.9, 790, 414/790.2; 53/259
See application file for complete search history.

(56) References Cited

U.S. PATENT DOCUMENTS 4,533,167 A * 8/1985 Johnson ..... B25J 13/082 294/86.4
4,676,542 A * 6/1987 Besold ..... B66C 1/425 294/106
4,696,501 A * 9/1987 Webb ..... B25J 13/082 294/103.1
4,799,724 A * 1/1989 Rekers ..... B65G 47/907 294/119.1
4,850,627 A * 7/1989 Franklin ..... B65B 35/38 294/183
4,872,803 A * 10/1989 Asakawa ..... B25J 9/1015 294/119.1
4,879,862 A * 11/1989 Nolte ..... B65B 25/141 53/247
5,087,169 A 2/1992 Tubke
5,101,979 A * 4/1992 Uno ..... G07D 11/0018 209/534
5,169,284 A 12/1992 Berger et al.
5,425,565 A 6/1995 Rogovein et al.
5,484,256 A 1/1996 Claassen
5,562,320 A * 10/1996 Bloomberg ..... B25J 15/0253 294/119.1
5,671,962 A * 9/1997 Otsuka ..... B25J 9/1612 294/119.1
5,931,634 A * 8/1999 Neri ..... B65H 31/32 271/217
5,997,064 A * 12/1999 Orita ..... B66C 1/445 294/119.1
6,082,797 A 7/2000 Antonette
6,637,739 B2 * 10/2003 Neri ..... B65B 13/20 101/232
6,860,531 B2 * 3/2005 Sherwin ..... B25J 15/0052 294/103.1
6,938,938 B2 * 9/2005 Risle ..... B25J 15/0253 294/119.1
7,547,052 B2 * 6/2009 Yohe ..... B65G 47/90 294/103.1
7,637,711 B2 * 12/2009 Wronski ..... B65H 31/06 414/793
8,276,957 B2 * 10/2012 Shibamoto ..... B25J 15/022 294/106
8,696,042 B2 * 4/2014 Rebstock ..... H01L 21/67017 294/119.1
2008/0185777 A1 8/2008 Hausler
2010/0156127 A1 * 6/2010 De Kervanoael .... B25J 15/0253 294/106
2012/0175217 A1 7/2012 Demmeler

FOREIGN PATENT DOCUMENTS

DE WO 2011036157 A1 * 3/2011 ..... B65H 1/027
EP 0217757 A2 4/1987
EP 0377398 A1 7/1990
FR 2740439 A1 4/1997
JP 01139439 A * 5/1989
JP 2010247912 A * 11/2010

OTHER PUBLICATIONS

International Preliminary Report on Patentability for corresponding International PCT Application No. PCT/EP2013/001203, Oct. 28, 2014.
International Search Report for corresponding International PCT Application No. PCT/EP2013/001203, Jul. 24, 2013.

* cited by examiner

GRIPPING DEVICE FOR GRIPPING SHEET MATERIAL

BACKGROUND

The present invention relates to a gripping device and a method for gripping sheet material, in particular a sheet-material stack, as well as to an apparatus which has the gripping device.

For transporting a stack of sheet material from a starting position to a target position there are known stationary transport devices which convey the entire stack from a starting position to a target position. Alternatively, it is also known to draw off the individual sheets individually one after the other from the sheet-material stack at the starting position and to convey them to the target position and to stack them up there again, where applicable. Since such apparatuses are elaborate and, with regard to a variable starting and target position, inflexible, in some applications the respective sheet-material stack is transported manually by a person. Instead of a manual transport it is also known, however, to employ a gripper which can grip the sheet-material stack and transport it to the target position. The gripper compresses the sheet-material stack at its upper and lower side, in order to achieve a grip-clamping of the sheet-material stack. Such grippers can be employed in particular for removing a sheet-material stack from a container and depositing the removed sheet-material stack at a desired target position.

For the processing of value documents there are used, for example, containers which are openable on one side or are permanently open, and into which one or several value-document stacks of loose value documents can be inserted. For removing the value documents, the container is usually disposed such that its open side points upward and the value documents stand in the container on their longitudinal edges.

When several value-document stacks are to be kept separated from each other in the container, e.g. to permit that the stacks can be distinguished from each other, the container can be provided with separating elements which divide the container into several partial regions, cf. FIG. 1*a*. The inner wall of the container as well as the separating elements usually have a meandering surface comprising several projections and recesses at their sides facing the value-document surfaces. To automatically remove the value-document stack from the container by a gripper, a gripper having several gripping fingers can be used, which penetrate into the recesses of the meandering surface from above. Accordingly, the recesses of the container and the gripping fingers of the gripper are adapted to each other with respect to their arrangement and size. The gripper has e.g. two rake-like gripping elements comprising several gripping fingers which can be moved toward each other and away from each other, in order to grip the value-document stack as soon as the gripping fingers have penetrated perpendicularly into the recesses of the container. With the aid of the gripper the desired value-document stack can thus be gripped, removed from the container and be deposited remote from the container or inserted into an apparatus for value-document processing.

A trouble-free removal of a sheet-material stack from the container in this way, however, is only successful with those sheet-material stacks in which the number of sheets is not too large. Because large stacks, due to their larger mass and inconvenient geometry, are susceptible to fall from the grip-clamping of the gripper when these stacks are removed. It is furthermore particularly difficult to reliably remove mixed stacks comprising sheet material of different sizes, because this leads to non-uniform mechanical properties of the sheet-material stack. A further difficulty results from the fact that the force which the gripper must exert on the stack surface in order to hold the stack firmly against gravity and against accelerating forces depends on the friction between the gripper and the sheet located at the stack surface as well as on the friction between the sheets of the stack, and that these friction forces vary depending on the type and state of the sheets. A reliable and trouble-free removal of sheet-material stacks has thus hitherto been possible only for certain types of sheet-material stacks.

SUMMARY

It is the object of the present invention to create an improved solution for removing a sheet-material stack located in a container from the container by means of a gripper and firmly holding it against gravity through grip-clamping.

With very large sheet-material stacks it has been observed that the force to be applied for gripping must be chosen so large that the gripping fingers can be elastically bent through the opposing force of the stack. By the outward bending of the gripping fingers the gripping force acts primarily only on the margin of the sheet material, so that the sheet-material stack can fall out from the grip-clamping.

The gripping device according to the invention has at least two gripping elements for gripping a sheet-material stack disposed between the gripping elements. The gripping elements can be moved toward each other in order to grip the sheet-material stack and moved away from each other in order to release the sheet-material stack. For this purpose, one of the gripping elements can be configured to be movable and the other one to be stationary or both can be configured to be movable. To achieve a grip-clamping of the sheet-material stack at both ends of the stack, the gripping device grips the stack by compressing the stack at both ends of the stack in the direction of the stack. The gripping elements respectively have at least one gripping finger. The gripping fingers can be laid against the stack end-sheet of the sheet-material stack to be gripped, which end sheet is located at the end of the sheet-material stack which faces the respective gripping element. According to the invention, at least one of the gripping fingers of one of the gripping elements is tiltable from its starting position, in which it is oriented substantially parallel to the surface of the stack end-sheet facing it, into a tilted position, in which it is inclined toward the surface of the stack end-sheet facing it. Preferably all of the gripping fingers of at least one of the gripping elements are configured in such a tiltable fashion. The second gripping element can also have tiltable gripping fingers.

In the starting position, in which the tiltable gripping finger is non-tilted, the gripping finger can penetrate perpendicularly into the recesses of a meandering surface of the side wall of a container. This is advantageous compared to permanently tilted gripping fingers, because these, due to the tilted position, would need more space, when they are to penetrate into such recesses, which would adversely affect the sheet-material quantity receivable by the container.

The tilting of the gripping finger, according to the invention, shifts the point of application, at which the gripping force of the gripping finger mainly acts on the sheet-material stack, to a gripping spot which does not lie in the margin, but in particular in the center region of the sheet-material stack. The tilting of the gripping finger counteracts a weakening grip-clamping which arises through the elastic bending of the gripping finger. This enables a reliable gripping and transporting of very large sheet-material stacks and of mixed stacks comprising sheet materials of different sizes. The gripping device according to the invention is very flexibly usable with respect to the sheet-material stack to be gripped, however. Because with the same gripping device there can be reliably removed both a very large sheet-material stack and a stack comprising very few individual sheets or even one single sheet from a container without performing a change of the gripping device.

Preferably, each gripping element respectively has at least two gripping fingers which extend parallel to each other and are disposed spaced apart from each other. The gripping elements are positioned relative to each other in particular such that the gripping fingers of the gripping elements are disposed mutually offset, i.e. the gripping fingers of one of the gripping elements are respectively congruent with the recesses which lie between the gripping fingers of the other gripping element. The tiltable gripping finger or gripping fingers of the gripping element are tilted such that in their tilted position they exert a grip-clamping on the stack which is sufficient for firmly holding the sheet-material stack against its gravity and in particular also against the accelerating forces required for transporting the sheet-material stack. The tilting effects that the sheet-material stack can be held solely through the grip-clamping without the sheet-material stack being supported at its lower side against gravity, i.e. without the stack resting on a rest.

The gripping device is movable in space and thus arranged for transporting a sheet-material stack from a starting position to a target position. For this purpose the gripping device can be fastened e.g. to the articulated arm of an articulated arm robot, in order to enable three-dimensional movements of the gripping device in space (translational and rotational motions). For example, the gripping device can be employed to remove a sheet-material stack from a container and to deposit the removed sheet-material stack at a desired target position. Alternatively, with the aid of the gripping device a removal of a sheet-material stack from an arbitrary storage or from an output pocket of a sheet material processing apparatus is also possible.

The respective tiltable gripping finger is tiltable around an axis which is oriented approximately parallel to the surface of the stack end-sheet facing the gripping finger and which encloses with the direction of the gripping finger a non-zero angle which is for example 90° or is approximately 90°. The gripping finger is tiltable in such a way that in its tilted position it is inclined along the direction perpendicular toward the surface of the stack end-sheet facing it (hereinafter also referred to as "stack surface"). The outer end of the tiltable gripping finger, which faces away from the fastening of the tiltable gripping finger at the gripping element, is inclined toward the stack surface. In the tilted position, the outer end of the tiltable gripping finger is shifted perpendicularly toward the stack surface, relative to those sections of the tiltable gripping finger which lie closer to the fastening of the tiltable gripping finger at the gripping element than the outer end. In the starting position of the tiltable gripping finger, however, the outer end of the tiltable gripping finger and the sections of the tiltable gripping finger which lie closer to the fastening of the tiltable gripping finger at the gripping element than the outer end, have the same position along the direction perpendicular to the stack surface. In its starting position the gripping finger can be laid against the stack end-sheet in particular in such a way that the gripping finger aereally contacts the stack end-sheet at least over a quarter of the length of the stack end-sheet, preferably at least over half the length, the length of the stack end-sheet being viewed in the direction in which the gripping finger points. With respect to its starting position, the gripping finger assumes in its tilted position an acute tilting angle. This acute tilting angle amounts in particular to 1°-20°, for example 2°-5°.

By the tilting of the tiltable gripping finger it is achieved that the gripping force, which the tiltable gripping finger exerts in its tilted position on the sheet-material stack, is exerted on the sheet-material stack primarily by the tiltable gripping finger's outer end which faces away from the fastening of the tiltable gripping finger at the gripping element. In the tilted position the outer end of the tiltable gripping finger exerts the gripping force on the sheet-material stack at a gripping spot on the stack end-sheet, which does not lie in the margin region but in the center region of the sheet-material stack. Center region of the sheet-material stack refers to that region which, viewed along the direction of the gripping finger, has a distance from both edges of the sheet-material stack which is at least 30% of the width of the sheet-material stack which the sheet-material stack has in the direction of the gripping finger. The gripping spot preferably lies along this direction approximately in the center of the sheet-material stack. The gripping spot at which the gripping finger in its tilted position substantially holds the sheet-material stack is e.g. a contact point, while due to the elasticity of the sheet-material stack an aereal contact of the stack end-sheet by the gripping finger is possible also in the tilted position. The advantage of the grip-clamping in the center region is that upon the transport of the sheet-material stack by means of the gripping device neither gravity nor the inertial force of the stack (upon the motion of the stack in space) can exert torque on the stack, independently of the direction in which the stack is held. It is particularly advantageous when at least one of the gripping elements has at least two of the above-mentioned tiltable gripping fingers which are disposed on both sides of the center of the sheet-material stack and in particular are disposed approximately symmetric to the center of the sheet-material stack. The respective outer end of the tiltable gripping finger exerts in its tilted position a gripping force on the sheet-material stack at a gripping spot in the center region of the sheet-material stack. The two gripping spots are disposed on both sides of the center of the sheet-material stack, they lie preferably symmetrically to the center of the sheet-material stack. In case of a mixed sheet-material stack with sheets of different sizes which are aligned, on one side, with the same sheet-material edge, the gripping spots of the gripping fingers are preferably chosen symmetrically to the center of the smallest sheet of the sheet-material stack.

In an improved embodiment, at least the gripping fingers of one of the gripping elements are configured for a compensating motion which allows an adaptation of the position of the gripping fingers to non-uniform sheet-material stacks. This can be the same gripping element which also has the one or more tiltable gripping fingers, and/or the other gripping element which has no tiltable gripping finger. For the compensating motion the gripping fingers are fastened to the gripping element in such a way that they are movable, relative to the gripping element, along the direction perpendicular to the stack surface of the sheet-material stack into mutually different positions. The gripping fingers configured for the compensating motion are fastened to the gripping element such that they are deflectable against a spring force, along the direction perpendicular to the stack surface, relative to the gripping element. Due to the fact that the two gripping fingers are movable perpendicular to the stack surface into mutually different positions, the position of each of the gripping fingers automatically adapts itself to a locally differently strong opposing force of the gripped sheet-material stack, which is differently strong at different places along the stack surface. This compensating motion of the gripping fingers is independent of the above-mentioned tilting motion for tilting the gripping fingers.

The movability of the gripping fingers into different positions perpendicular to the bank note stack has the effect that the position of the respective gripping finger, which the latter assumes relative to the gripping element at the point in time of the grip-clamping of the stack, is variable in dependence on the local stack height and/or in dependence on the local mechanical properties of the stack. This compensating motion of the gripping fingers avoids that the gripping force is distributed in a strongly varying fashion over the gripping fingers. Without the compensating motion a very large portion of the gripping force would fall to that one of the gripping fingers which grips in the region of a higher stack height, whereas a small gripping force would fall to the other gripping finger which grips in the region of a lower stack height. In case of a strongly varying force distribution there exists the danger that the stack may slip, under the influence of gravity, from the grip-clamping of the other gripping finger and the stack is rotated through the arising torque around the gripping spot of the first-mentioned gripping finger. By the compensating motion of the gripping fingers it is achieved that the gripping forces of the gripping fingers exerted for the grip-clamping are assimilated to each other, when a bank note stack with locally different stack height and/or locally different mechanical properties is gripped. For example, the two gripping fingers exert approximately the same force on the stack. Thus, it is possible to reliably grip also non-uniform sheet-material stacks.

For example, the two gripping fingers of the gripping element are formed by a fork which for enabling the compensating motion is rotatable around an axis which is oriented approximately parallel to the gripping fingers and in particular lies approximately on the perpendicular bisector between the two gripping fingers. Upon the rotation of the fork around the axis the gripping fingers move in opposite directions. When one of the gripping fingers is deflected away from the stack surface, the other gripping finger is automatically deflected in the opposite direction of the stack surface. The rotational motion around the axis of the fork of the gripping finger is counteracted by a spring force.

The gripping device preferably has a stopping mechanism for switching off the drive, which drives the relative motion of the gripping elements, and thus for automatically stopping the relative motion of the gripping elements as soon as an opposing force of the sheet-material stack, generated upon the grip-clamping, exceeds a certain value. This achieves that a predefined gripping force of the gripping device acts on the sheet-material stack, which is sufficient for reliably gripping the stack but not for damaging it.

In an exemplary embodiment, the gripping device has a belt which is mechanically coupled with one of the gripping elements, in order to move the gripping element relative to the other gripping element of the gripping device through the belt motion and in order to grip a sheet-material stack disposed between the two gripping elements through a grip-clamping. The gripping element is mechanically designed in such a way that the drive of the belt motion also makes available the force for tilting the tiltable gripping finger. The tilting is here triggered through the opposing force of the compressed sheet-material stack. For tilting the gripping finger there is thus, advantageously, no further drive or actuator required. But the relative motion of the gripping elements can also be achieved without the aid of belts.

In this embodiment, for the stopping mechanism e.g. the belt tension can be monitored by a sensor which is arranged to stop the drive of the belt motion when a certain belt tension is exceeded. Preferably, the sensor for the mechanical monitoring of the belt tension is disposed in that section along the belt, in which in the case of the grip-clamping of the sheet-material stack an increased belt tension is generated, upon the further travel of the gripping element, through the opposing force of the sheet-material stack. In particular, the sensor has a roller which, for monitoring the belt tension, is pressed against the belt (e.g. by spring force) and which, in the case of the grip-clamping of the sheet-material stack, is deflected through the belt tension which is increased upon the further travel of the gripping element. The deflection of the roller is monitored e.g. by a proximity sensor which monitors the position of the roller. If a certain deflection of the roller is exceeded, the sensor switches off the motor of the belt motion.

The gripping device is arranged in particular for the removal of a sheet-material stack from a container which has side walls with a meandering surface. The side wall with the meandering surface can be formed by a separating element accommodated in the container or by the inner wall of the container itself. Preferably, for this purpose the gripping device has two gripping elements respectively comprising at least two gripping fingers which are configured to penetrate into recesses of the meandering surface of a side wall of the container in which the sheet-material stack is contained. If the container is so disposed that its open side points upward and the sheet material stands on its edges in the container, the gripping device can grip the sheet-material stack and lift it from the container against gravity.

The side wall of the container, which has the meandering surface, has in some containers a projection-free section, i.e. a section in which no projection of the meandering side wall is present. The stack end-sheet, of a sheet-material stack contained in the container, which faces this side wall may bulge out in this projection-free section toward the side wall. Preferably, in such a case at least one of the gripping fingers, which is provided for penetrating into this projection-free section of the side wall upon gripping the sheet-material stack, is thus beveled at its outer end in such a way that it can penetrate between the stack end-sheet bulged out toward the side wall and the projection-free section. The outer end of this gripping finger, which lies at that side of the gripping finger which faces away from the fastening of the gripping finger, is beveled such that the thickness of the gripping finger decreases along the direction pointing toward the center of the projection-free section. This makes it possible that also a bulged stack end-sheet can be reliably gripped by the gripping device and that the complete stack can be removed in damage-free manner from the container.

The invention also includes an apparatus for processing sheet material, in particular value documents, which apparatus has a gripping device according to the invention. The apparatus can be a value document processing apparatus which has an input pocket for the value documents, a transport system for transporting the value documents, sensors for checking the value documents and one or several output pockets for the value documents. But the apparatus can also make available substantially only the gripping device and be configured to be built on such a value document processing apparatus, or be provided for employment with such a value document processing apparatus. The gripping device of the apparatus can be arranged to insert the gripped value-document stack into the input pocket of the value document processing apparatus and/or to remove the gripped sheet-material stack from an output pocket of the value document processing apparatus.

The invention also relates to a method for gripping a sheet-material stack by means of the gripping device. In so doing, there is effected a relative motion of the gripping elements toward each other through a relative motion of the gripping elements, in order to compress a sheet-material stack disposed between the two gripping elements and to grip it through grip-clamping. At least one of the gripping fingers is tilted from its starting position into its tilted position. The tilting of the gripping finger can be carried out already before the start of the relative motion or during the relative motion. The relative motion of the gripping elements is automatically stopped as soon as a grip-clamping is achieved, in particular as soon as an opposing force of the sheet-material stack generated upon the grip-clamping exceeds a predetermined value. Then, the sheet-material stack gripped through the grip-clamping is transported by means of the gripping device. The relative motion of the gripping elements preferably remains stopped for a certain waiting period after the stop of the relative motion and after this waiting period a subsequent gripping of the sheet-material stack is carried out, upon which the relative motion of the gripping elements toward each other is started anew in order to produce a reliable grip-clamping of the sheet-material stack also in the case of a relaxation of the sheet-material stack. The relative motion of the gripping elements started anew is automatically stopped again, in particular as soon as the opposing force of the sheet-material stack generated upon the anew grip-clamping exceeds the predetermined value anew.

The method is in particular advantageous for the removal of a sheet-material stack from a container by means of the gripping device. The tilting of the gripping fingers is then effected e.g. after the gripping fingers have penetrated into the recesses of a meandering side wall. The step of transporting the sheet-material stack gripped through the grip-clamping by means of the gripping device includes in this case that the grip-clamping removes the gripped sheet-material stack from the container.

The gripping device carries out the subsequent gripping while it transports the sheet-material stack, in particular after the gripping device has removed the sheet-material stack from the container. By the subsequent gripping the desired gripping force is adjusted anew, e.g. to approximately the same value as upon the first grip-clamping. By the subsequent gripping there is achieved a reliable gripping of also such sheet-material stacks which relax. The relaxation of the sheet-material stacks may be caused by an inelastic deformation of the sheet-material stack through the compressing upon gripping, e.g. small repositionings among the sheets of the sheet material. The waiting period is selected such that after the grip-clamping has been achieved the sheet-material stack has sufficient time to relax under the influence of the gripping force, the gravity and, where applicable, its inertial force. For example, the waiting period between the automatic stop of the relative motion and the subsequent gripping amounts to some tenths of a seconds.

Hereinafter, the invention is described with reference to bank notes as an example of value documents. The invention is not restricted thereto, however, but sheet material is generally suitable, in particular for any types of value documents. The invention enables e.g. the automatic processing of large quantities of bank notes, whereby for the processing the bank notes can be prepared and filled into the containers in advance. Removing the bank notes from the container and inserting the bank notes removed from the container into the input pocket of a bank note processing apparatus with the aid of the gripping device as well as the processing of the bank notes in the apparatus can then be effected completely automatically, without manual actions of an operating person.

BRIEF DESCRIPTION OF THE DRAWINGS

Hereinafter the invention will be explained by way of example with reference to the following Figures. There are shown.

DETAILED DESCRIPTION OF VARIOUS EMBODIMENTS

Figure 1A:
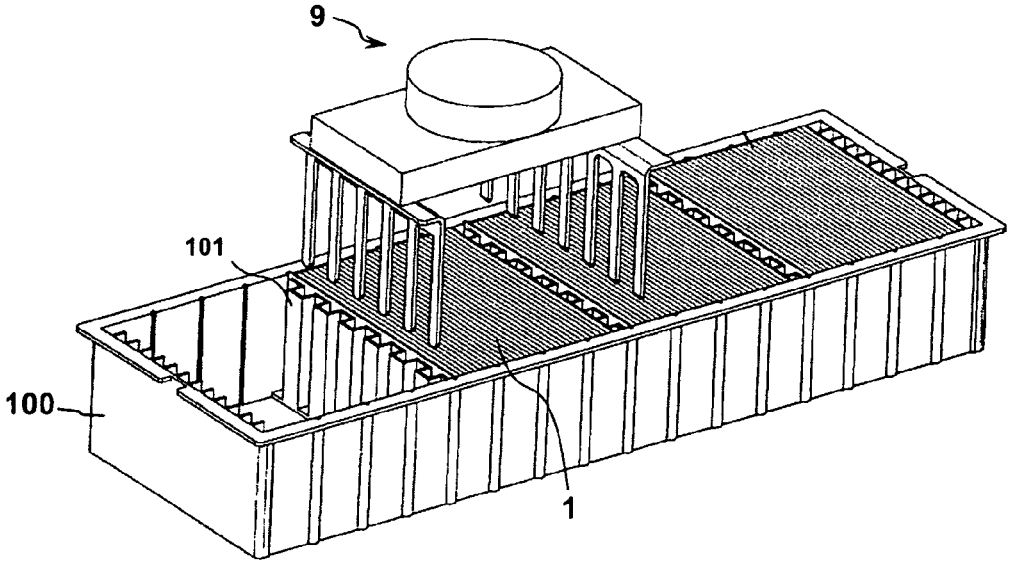
FIG. 1*a-b* a container partly filled with bank notes, together with a per se known gripper (FIG. 1*a*) and a container together with gripping elements of a gripping device of the invention (FIG. 1*b*), FIG. 2*a-d* gripping device of the invention at various points in time, when one of the gripping elements is moved toward the other, FIG. 3*a-b* gripping device upon gripping a leftward-yielding bank note stack (FIG. 3*a*) or upon gripping a rightward-yielding bank note stack (FIG. 3*b*), FIG. 4*a-b* gripping element with conventional gripping fingers, and FIG. 5*a-b* specially configured gripping element for reliably gripping the bank notes.

FIG. 1*a* shows a container 100 partly filled with bank notes together with a per se known gripper 9. The container 100 is formed of a housing closed on five sides, which has several subdivisions which can receive separating elements 101 in an interchangeable fashion. Between the meandering separating elements 101 bank note stacks 1 can be input. The bank notes are input such that they stand on their longitudinal edges in the container 100. This enables a reliable and ergonomically favorable filling of the container. For bank notes to be automatically removed from the container 100 the gripper 9 is lowered into the container 1, the gripping elements thereof penetrating into the recesses of the separating elements 101. After the lowering the two gripping elements of the gripper 9 are moved toward each other to grip a bank note stack 1 and lift it from the container.

Figure 1B:
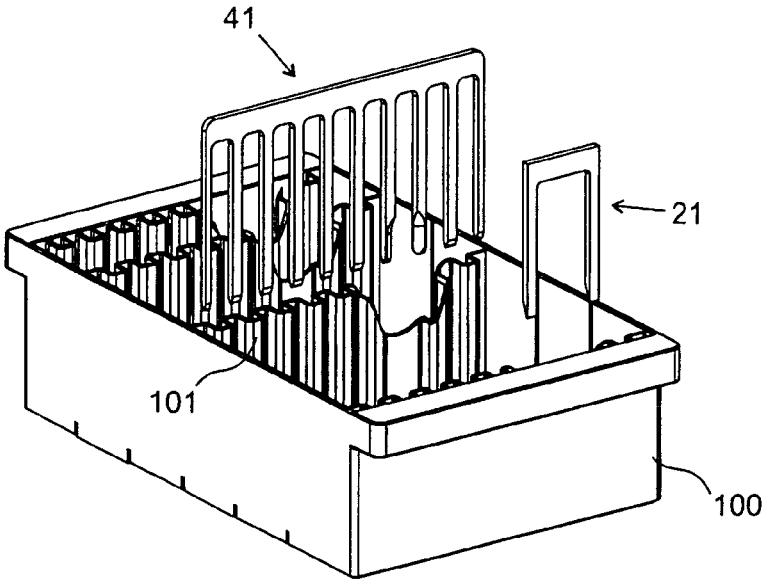

In FIG. 1*b* there is also represented a container 100 for receiving bank notes standing on their longitudinal edges (the bank note stack 1 is not shown in FIG. 1*b*). For removing the bank notes, a gripping device 10 having two gripping elements 21, 41 according to the invention is employed, which can be moved toward each other and away from each other. The gripping elements 21, 41 are part of the gripping device 10 which will be described in detail with reference to the FIGS. 2*a-d* and from which only the two gripping elements 21, 41 are shown in FIG. 1*b*. To enable the bank note stack 1 located in the container to be reliably gripped and later deposited, at least one of the gripping elements substantially extends over the entire inside width of the container 100. Additionally, the gripping device 10 can have sensors for the positioning of the gripping elements 21, 41, whose signals are evaluated by a control device in order to control the motion of the gripping device 10.

For example, in each container all the bank notes are aligned with their side edges with the same side wall of the respective container 100. This achieves that the gripping elements 21, 41 can grip the respective bank note stack 1—without adaptation of the lateral position of the gripping elements 21, 41—always at the same gripping spots (with regard to the bank note stack). The lateral position of the gripping element 21 in FIG. 1*b* is e.g. to the right of the container center and chosen such that the two gripping spots are disposed on both sides of and symmetrically to the center of the smallest possible bank note format, if the bank notes are aligned with the right side wall of the container 100. If the bank notes are always aligned with the right side wall, these gripping spots with regard to the smallest possible bank note format lie at the same positions in each bank note stack.

The separating elements 101 are equipped with a meandering surface on both sides, so that the gripping elements 21, 41 can penetrate in a defined manner between bank notes located in the container 100 in order to grip a bank note stack and to remove it from the container 100. The arrangement and extension of the gripping fingers of the gripping elements 21, 41 are adapted to the meandering form of the separating elements 101, so that they can penetrate into the recesses of the meandering surface. Similar to the separating elements, also the front and rear inner walls of the container have a meandering surface with projections and recesses, which also enables the penetration of the gripping fingers of the gripping elements.

The bank note stack 1 removed from the container 100 by the gripping device 10 is then supplied to a processing for example by means of a bank note processing apparatus. For this purpose, the gripping device 10 inserts the bank note stack into an input pocket of the bank note processing apparatus, from which the bank notes are transported away individually by means of a singler. For this purpose, the gripping device 10 is disposed in the region of the input pocket of the bank note processing apparatus, so that bank notes removed from the container 100 can be inserted into an input pocket. Within the range of the gripping device 10 there can be provided a suitable receiving means for one or several containers 100. Then, the bank notes are processed in the bank note processing apparatus, deposited in output pockets of the bank note processing apparatus and brought to account.

Figure 2A:
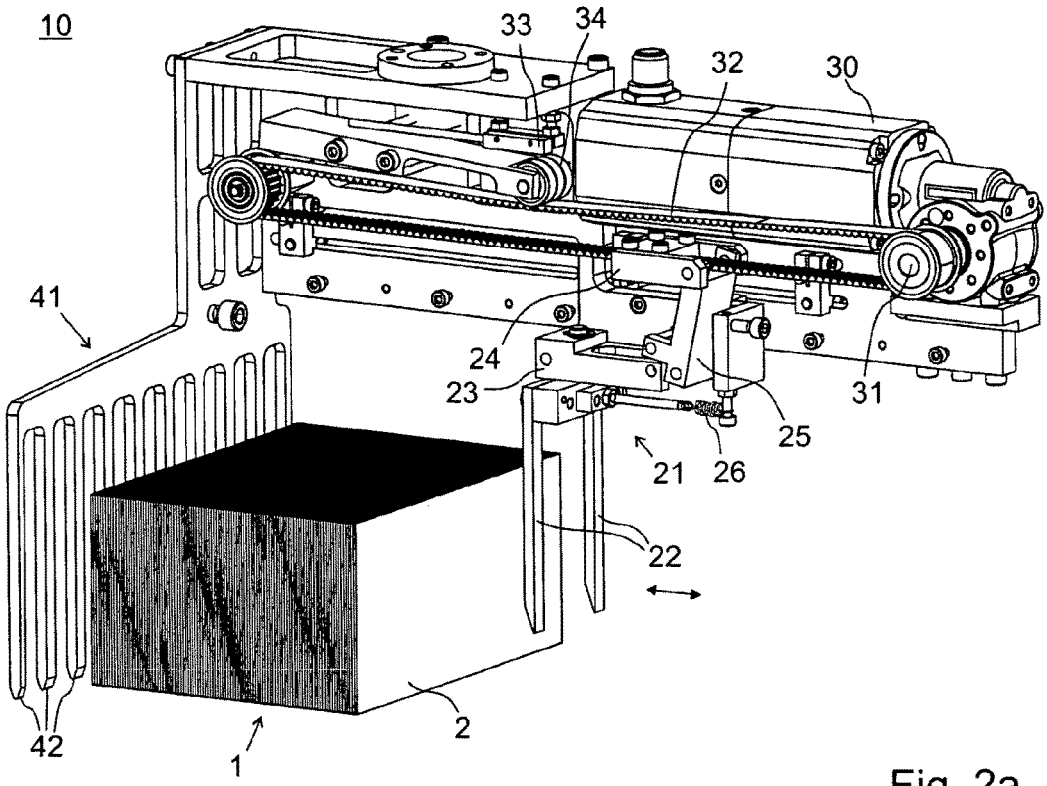

FIG. 2*a* shows a gripping device 10 having the two gripping elements 21 and 41 according to the invention. For gripping a bank note stack 1 the movable gripping element 21 is moved toward the stationary gripping element 41. The gripping element 21 of the gripping device 10 has a slide 24 which is mechanically coupled with a belt 32 of the gripping device 10. Through the motion of the belt 32 the gripping element 21 can be moved linearly toward the gripping element 41 and away from it. The belt 32 is moved by a motor 30 which drives the drive roller 31 of the belt. The stationary gripping element 41 has a plurality of gripping fingers 42, which are distributed over the entire length of the bank note stack. The stationary gripping element can alternatively also have less gripping fingers. The movable gripping element 21 in this example merely has two gripping fingers 22. But, alternatively, for the movable gripping element there can also be employed, instead of the two gripping fingers 22, one single wide gripping finger or more than two gripping fingers. Also the movable gripping element 21 can have a plurality of gripping fingers 22 which are distributed over the entire length of the bank note stack.

Figure 2B:
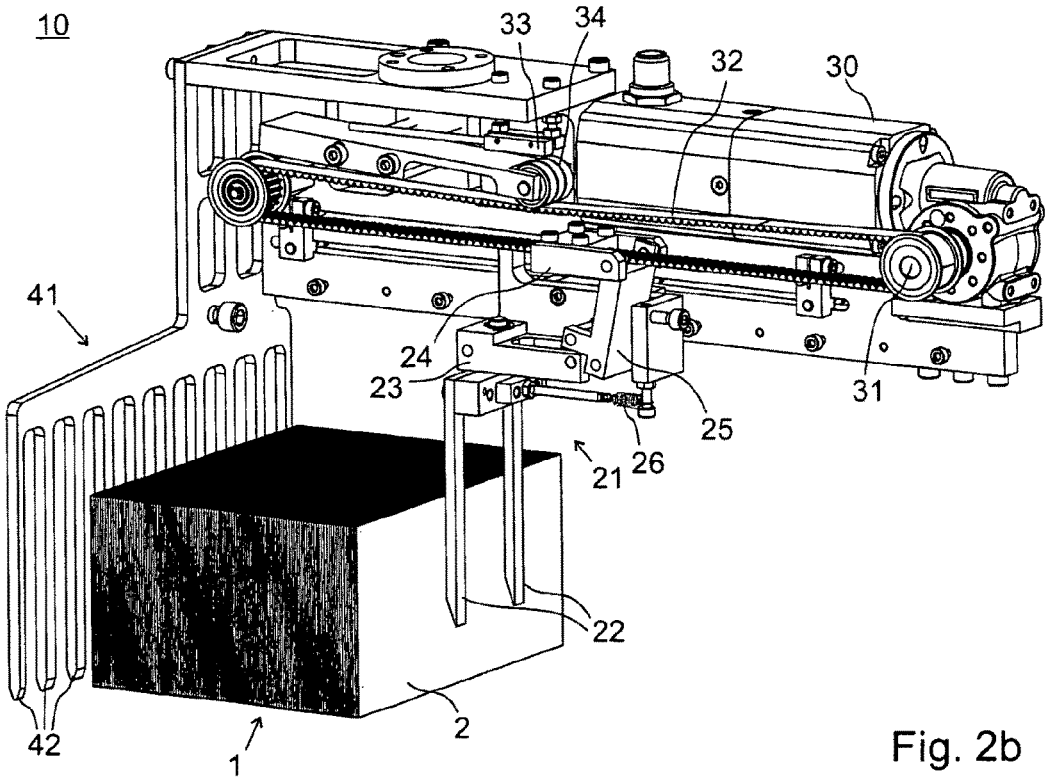
Figure 2C:
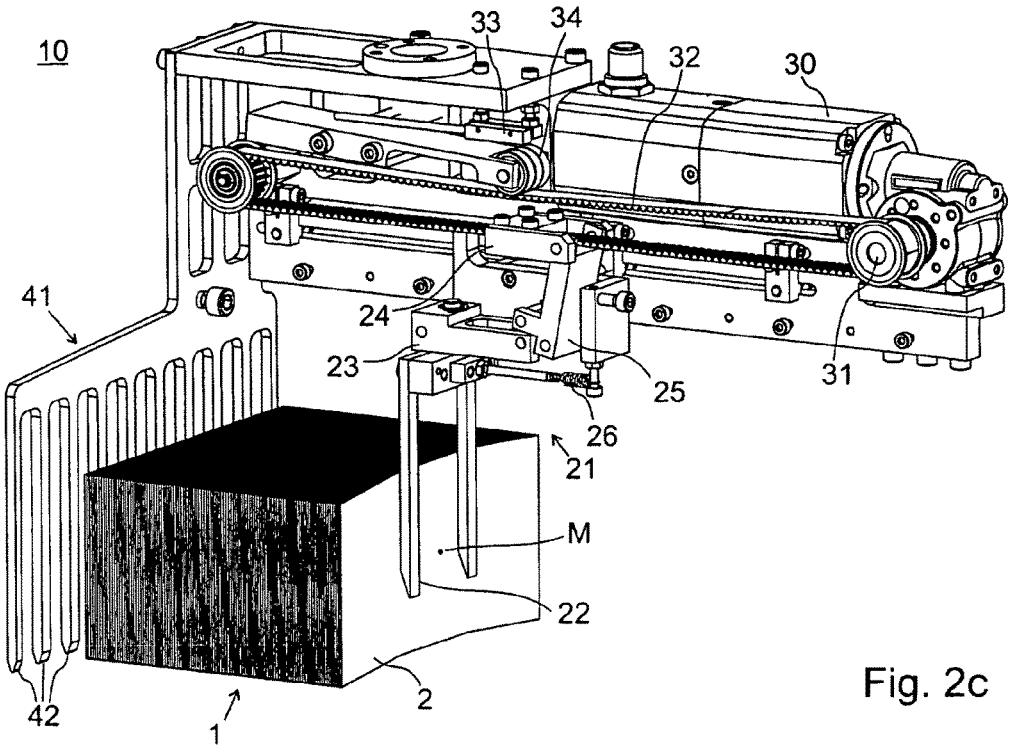
Figure 2D:
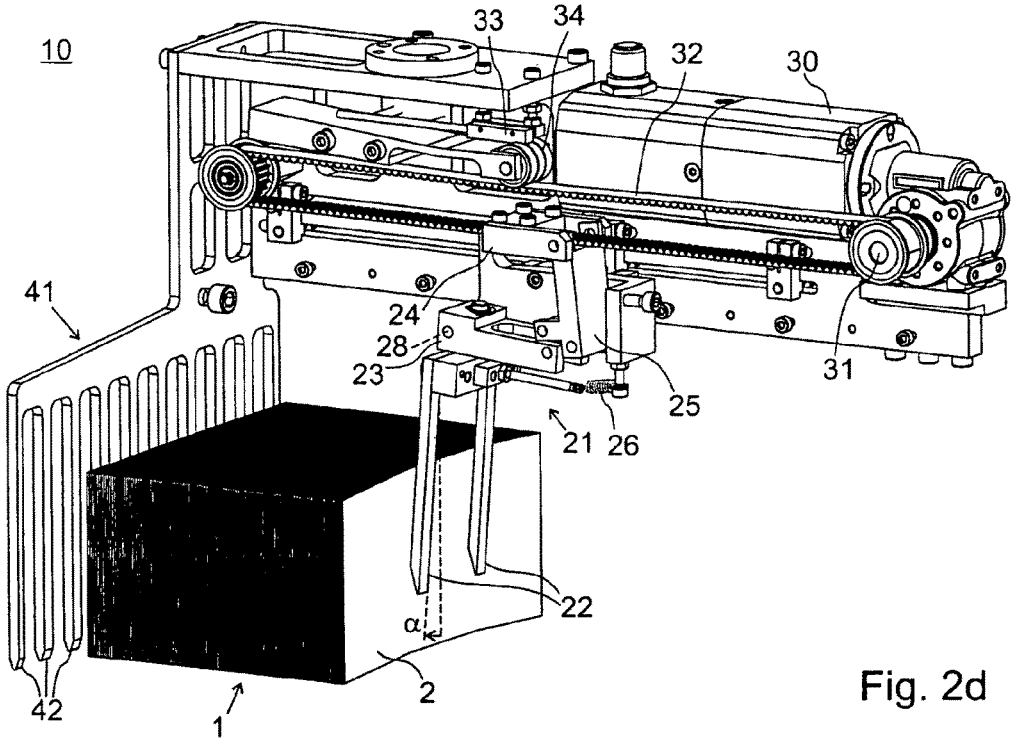

In FIGS. 2*a-d* the gripping device 10 is shown at various points in time, when the gripping element 21 is moved continuously or step by step toward the other gripping element 41, in order to grip the bank note stack 1. In FIG. 2*a*, the gripping element 21 is moved toward the stack end-sheet 2 of the bank note stack 1, but not yet contacts this. In FIG. 2*b* the point in time of the contact between gripping element 21 and stack end-sheet 2 is represented. FIG. 2*c* shows a point in time at which the bank note stack 1 is already pressed against the gripping element 41 by the gripping element 21, but the gripping fingers 22 are still in their untilted starting position A. FIG. 2*d* shows the gripping device, after the gripping fingers 22 have been tilted into their tilted position K and the bank note stack 1 is gripped.

The gripping fingers 22 of the gripping element 21 are tiltable toward the bank note stack 1 by a mechanical tilting mechanism which the gripping element 21 has. The function of the tilting mechanism is illustrated by a comparison of the FIGS. 2*c* and 2*d*. Starting out from FIG. 2*c*, in which the gripping fingers 22 are in their untilted starting position A, the slide 24 of the gripping element 21 is moved further to the left by means of the belt 32. Upon the further motion of the gripping element 21 an opposing force is exerted on the gripping fingers 22 by the bank note stack 1, which opposing force prevents the gripping fingers 22 and the bottom member 23 of the gripping element 21 connected therewith from following the leftward motion of the slide 24. The further motion of the slide 24 to the left and the opposing force of the bank note stack 1 on the gripping fingers 22 and on the bottom member 23 leads to a torque acting on the side part 25 of the gripping element 21, which is accordingly mounted at the slide 24 and at the bottom member 23. The side part 25 is thereby rotated counterclockwise by an angle. Through the rotation of the side part 25 the bottom member 23 of the gripping element, which is mounted on the left side thereof, is rotated clockwise. The gripping fingers 22 fastened to the bottom member 23 are tilted into their tilted position K, e.g. by a tilting angle $\alpha$ of few degrees around the axis 28, by the rotation of the bottom member 23, cf. FIG. 2*d*. The rotation of the bottom member 23 is counteracted by the force of the spring 26, which is tensioned by the rotation of the bottom member 23. For releasing the bank note stack 1 the gripping elements 21, 41 are moved apart. As soon as the opposing force of the bank note stack 1 ceases, the gripping element 21 returns to its original state through the force of the spring 26, the gripping fingers 22 returning to their untilted starting position A.

Additionally or alternatively to the just described purely mechanically controlled tilting mechanism, also an electronic triggering and controlling of the tilting mechanism of the gripping fingers is possible, e.g. with the aid of corresponding actuators for tilting the gripping fingers and sensors. For this purpose, there can be employed sensors which detect the position of the movable gripping element and/or which upon the compressing of the stack detect the opposing force of the bank note stack, in order to trigger the tilting of the gripping fingers and to stop the relative motion of the gripping elements.

If the bank note stack to be gripped is located in a container, such as e.g. the container 100 of FIG. 1*b*, the movable gripping element 21 is moved, in a lifted position of the gripping device 10, toward the stationary gripping element 41 (FIG. 2*a*, FIG. 2*b*), i.e. before the gripping elements are lowered into the container 100. Only when the position of the two gripping elements 21, 41 is correct for penetrating into the recesses of the respective meandering surface, the gripping device 10 is lowered into the container 100. This lowering takes place between the points in time shown in the FIGS. 2*b* and 2*c*. After the gripping fingers having penetrated into the recesses of the separating elements 101 or the inner wall of the container 100, the movable gripping element 21 is further moved toward the gripping element 41, in order to compress the bank note stack 1 (FIG. 2*c*) and tilt the gripping fingers 22 (FIG. 2*d*). The bank note stack 1 is thus gripped and can then be reliably lifted from the container 100.

The gripping device 10 has e.g. a mechanically controlled stopping mechanism for automatically stopping the motion of the gripping element 21 as soon as an opposing force of the sheet-material stack 1 generated upon the gripping exceeds a certain value. In the mechanically controlled stopping mechanism the belt tension of the belt 32 is monitored by a sensor. The sensor for monitoring the belt tension is disposed in that section along the belt 32, in which in the case of the grip-clamping of the sheet-material stack, upon the further motion of the gripping element 21, an increased belt tension is generated through the opposing force of the sheet-material stack 1. In the FIGS. 2*a-d*, this is the section of the belt 32 which along the moving direction of the belt lies between the slide 24 of the gripping device 21 and the drive roller 31.

The sensor has a roller 34 which for monitoring the belt tension is pressed against the belt with a spring. In the case of the grip-clamping of the sheet-material stack 1 the belt tension in the region of the roller 34 is increased through the opposing force of the sheet-material stack 1 acting during the further motion of the gripping element 21 and through the driving power of the drive roller 31. Through the increased belt tension the roller 34 is deflected against the spring force by the belt 32 (compared to FIG. 2*c*, the roller 34 in FIG. 2*d* is deflected slightly upward). The deflection of the roller 34 is monitored e.g. by a proximity sensor 33 which monitors the position of the roller e.g. inductively or capacitively. If a certain deflection of the roller 34 is exceeded, the proximity sensor 33 switches off the motor 30 employed for driving the belt, so that the motion of the gripping element 21 is automatically stopped. The motor 30 is preferably a motor with self-locking gearing, so that the grip-clamping of the bank note stack 1 is also maintained when the motor 30 is switched off. When the gripping elements 21, 41 are moved apart, the roller 34 is again pressed, as soon as the belt tension is normal again, against the belt 32 by the spring force counteracting the deflection.

In the case of bank note stacks, foil elements of the bank notes, e.g. security elements which are applied on the bank notes, may lead to a non-uniform stack height and/or to non-uniform mechanical properties of the bank note stack 1. Because the foil elements can lead to a local arching of the bank notes in a certain region or increase the local thickness of the bank notes. With the plurality of bank notes in a bank note stack, altogether there arise bank note stacks with an oblique or wavy surface or which in dependence on the position along the stack surface have a different elasticity and thus provide a locally different opposing force, cf. FIGS. 3*a-b*.

In order to reliably grip even these bank note stacks, in a preferred embodiment at least one of the gripping elements (the one which also has tiltable gripping fingers and/or the other gripping element) is configured to perform a compensating motion which allows the gripping element to adapt to non-uniform sheet-material stacks. This is explained hereinafter with the example of the gripping element 21. For gripping the bank note stack, the two gripping fingers 22 of the gripping element 21 are disposed on both sides of the center M of the bank note stack 1, cf. FIG. 2*c*. The gripping fingers 22 are fastened to the bottom member 23 of the gripping element 21 such that they are movable, relative to the bottom member 23, along the direction perpendicular to the stack surface of the sheet-material stack 1, into mutually different positions. This compensating motion of the gripping fingers is independent of the tilting motion, shown in the FIGS. 2*c-d*, for tilting the gripping fingers.

Figure 3B:
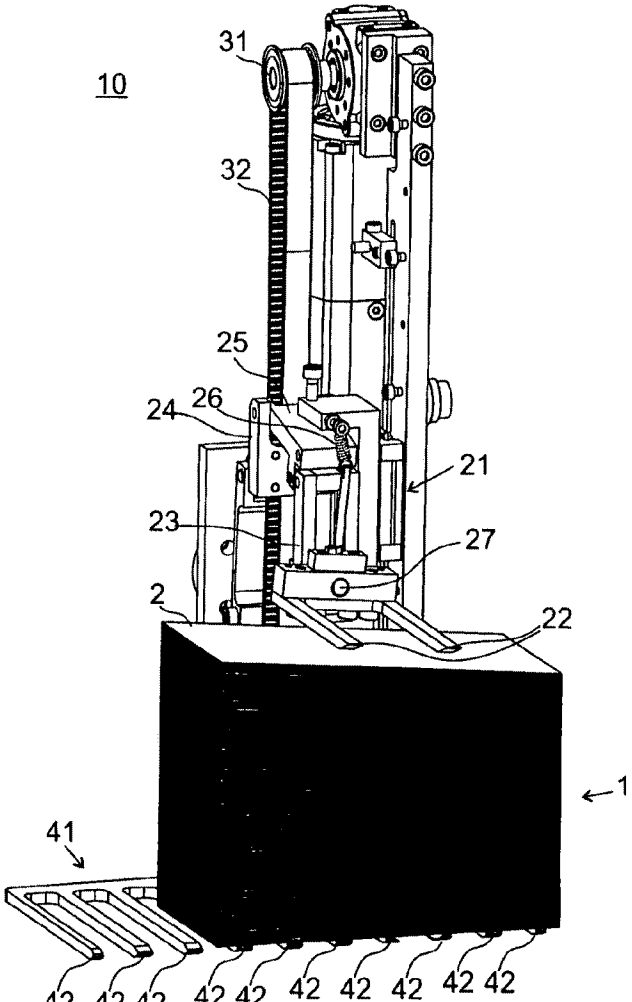
Figure 3A:
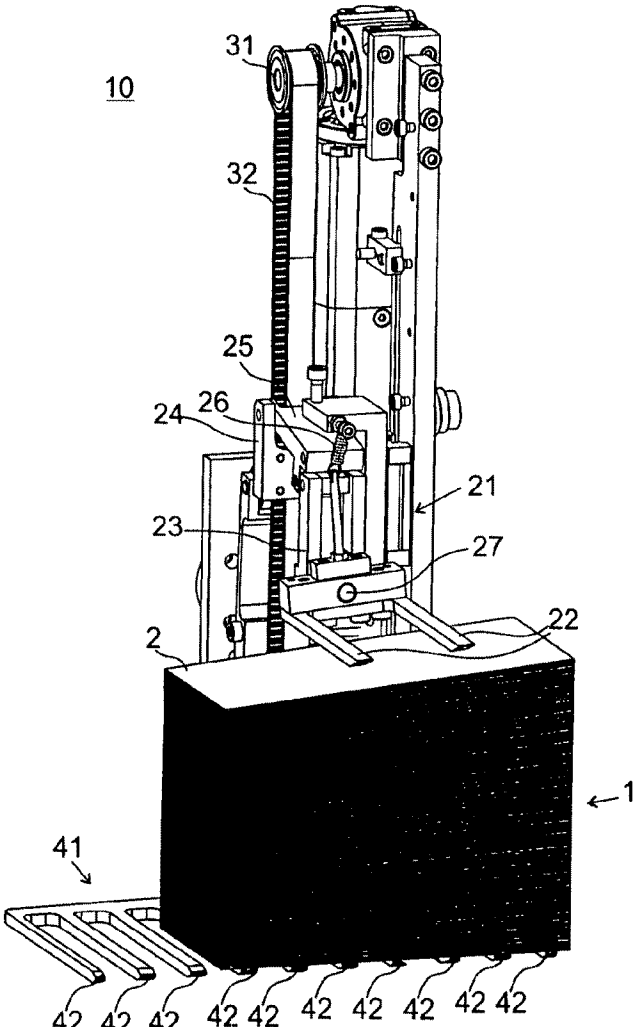

In the example of the FIGS. 3*a-b* the gripping fingers 22 are formed by a fork. This fork is rotatably mounted at an axis 27 which is oriented approximately parallel to the gripping fingers 22 and which lies approximately on the perpendicular bisector between the two gripping fingers, cf. FIGS. 3*a-b*. The two gripping fingers 22 are thus deflectable perpendicular to the stack surface into various positions. Upon gripping a stack having a non-uniform height or non-uniform mechanical properties the gripping fingers thus move in opposite directions. The spring force of the spring 26 counteracts the rotation of the gripping fingers 22 around the axis 27. In FIG. 3*a* the gripping device 10 grips a sheet-material stack 1, whose left side has a higher elasticity than its right side, so that the gripping fingers 22 upon compressing the stack are automatically slightly rotated counterclockwise around the axis 27. In FIG. 3*b* the gripping device 10 grips a different sheet-material stack 1, whose right side has a higher elasticity than its left side, so that the gripping fingers 22 are slightly rotated clockwise around the axis 27.

Figure 4A:
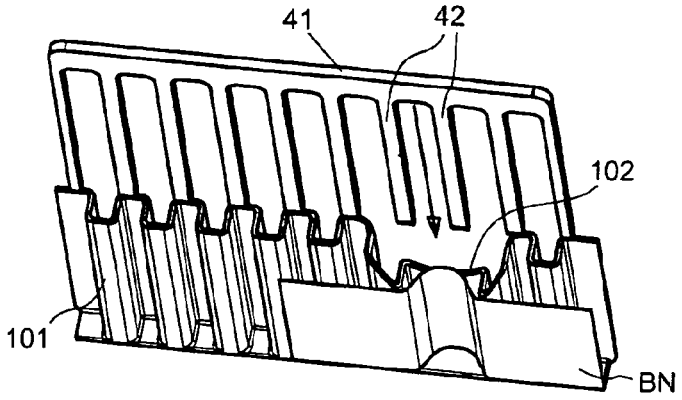
Figure 4B:
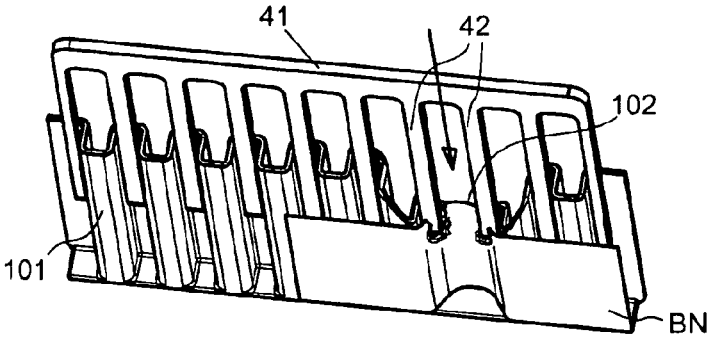

In the FIGS. 4*a-b* the gripping element 41 is shown upon penetrating into the recesses of the meandering surface of a separating element 101 contained in a bank note container 100. For the bank note stack to be more easily manually removed from and inserted into the container 100, the separating element 101 has a projection-free section 102, at which the meandering form is interrupted and which has a recessed handle. A bank note BN, e.g. the stack end-sheet 2 of a bank note stack 1 received in the container, can bulge out in this projection-free section 102, cf. FIG. 4*a*. When the gripping element 41 is lowered there thus exists the danger that the two gripping fingers 42 hitting this projection-free section 102 do not penetrate into the slit between the bank note BN and the separating element 101 but hit the face of the bank note BN and damage this, cf. FIG. 4*b*.

Figure 5A:
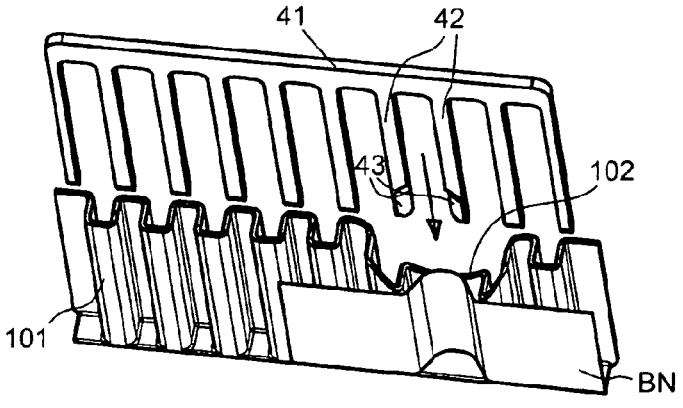
Figure 5B:
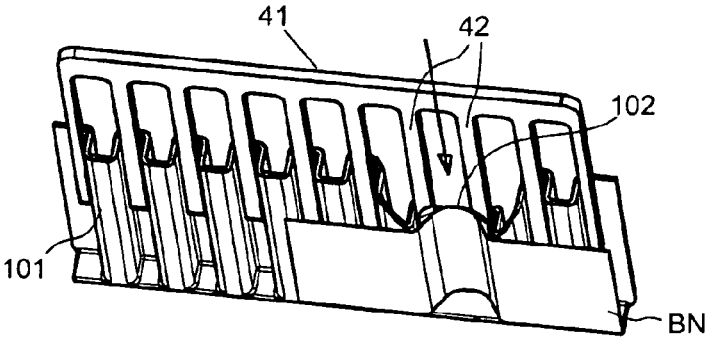

In the FIGS. 5*a-b* there is shown an embodiment of the gripping fingers, which is improved in this regard. The two gripping fingers 42, which upon gripping the sheet-material stack are provided for penetrating into the projection-free section 102, are beveled at their outer ends. The bevel is such that the thickness of the gripping finger, which this has perpendicular to the direction of the gripping finger, decreases along the direction pointing toward the center of the projection-free section 102. Thus, these gripping fingers can penetrate between the bulged out bank note BN and the projection-free section 102 without problems, cf. FIG. 5*b*. Also in the case of a bank note bulging out in a projection-free section, this bank note or the stack can therefore be reliably gripped without damaging bank notes.

The invention claimed is:

1. A gripping device for gripping and transporting a sheet-material stack, which has at least two gripping elements for gripping a sheet-material stack disposed between the gripping elements, which are movable toward each other in order to grip the sheet-material stack through a grip-clamping, wherein the gripping elements respectively have at least one gripping finger which can be laid against a stack end-sheet located at that end of the sheet-material stack facing the respective gripping element such that the gripping finger aereally contacts the respective stack end-sheet, wherein at least one of the gripping fingers of at least one of the gripping elements is tiltable from a starting position (A), in which the gripping finger is oriented substantially parallel to the surface of the stack end-sheet facing it, into a tilted position (K), in which the gripping finger is inclined toward the surface of the stack end-sheet facing it, wherein the gripping device has a stopping mechanism for stopping the relative motion of the gripping elements, in which the drive of the relative motion is automatically stopped as soon as an opposing force of the sheet-material stack generated upon the grip-clamping exceeds a certain value, and wherein the gripping device has a belt which is mechanically coupled with one of the gripping elements, in order to move this gripping element relative to the other gripping element of the gripping device through the belt motion and in order to grip the sheet-material stack disposed between the two gripping elements through a grip-clamping, wherein the stopping mechanism includes that the belt tension is monitored by a sensor which is arranged to stop the drive of the belt motion when a certain belt tension is exceeded.

2. The gripping device according to claim 1, wherein the tiltable gripping finger is tiltable in such a way that the outer end of the tiltable gripping finger, which faces away from the fastening of the tiltable gripping finger at the gripping element, is inclined, by the tilting, toward the surface of the stack end-sheet facing the tiltable gripping finger.

3. The gripping device according to claim 1, wherein the tiltable gripping finger is tiltable around an axis which is oriented approximately parallel to the surface of the stack end-sheet facing the gripping finger and which encloses a non-zero angle with the direction of the gripping finger.

4. The gripping device according to claim 1, wherein tilting the gripping finger shifts the point of application of the gripping force of the tiltable gripping finger to a gripping spot which lies in the center region of the sheet-material stack.

5. The gripping device according to claim 1, wherein when the one or more tiltable gripping fingers are in the tilted position, the gripping elements exert a grip-clamping on the sheet-material stack, which is sufficient for firmly holding the sheet-material stack against its gravity through the grip-clamping.

6. The gripping device according to claim 1, wherein the gripping element having the tiltable gripping finger is mechanically coupled with a belt, in order to move the gripping element relative to the other gripping element of the gripping device by the belt motion and in order to grip the sheet-material stack disposed between the two gripping elements through a grip-clamping, wherein the gripping element is mechanically designed in such a way that the drive of the belt motion also makes available the force for tilting the tiltable gripping finger.

7. The gripping device according to claim 1, wherein at least the gripping fingers of one of the gripping elements are configured for a compensating motion which allows an adaptation of the position of the gripping fingers to non-uniform sheet-material stacks, wherein the gripping fingers are fastened to the gripping element in particular in such a way that they are movable, relative to the gripping element, along the direction perpendicular to the stack surface of the sheet-material stack, into mutually different positions.

8. The gripping device according to claim 7, wherein the gripping element has two gripping fingers which are formed by a fork which for the compensating motion is rotatable around an axis which is oriented approximately parallel to the gripping fingers and preferably lies approximately on the perpendicular bisector between the two gripping fingers.

9. The gripping device according to claim 1, wherein the gripping device is arranged to remove a sheet-material stack from a container which has at least one side wall with a meandering surface, and that the gripping device has two gripping elements with respectively at least two gripping fingers which are configured to penetrate into recesses of the meandering surface of the side wall of the container.

10. The gripping device according to claim 9, wherein the side wall of the container, which has the meandering surface, has a projection-free section, so that the stack end-sheet of a sheet-material stack contained in the container can bulge out in this projection-free section toward the side wall, and that at least one of the gripping fingers, which is provided for penetrating into this projection-free section of the side wall upon gripping the sheet-material stack, is beveled at its outer end in such a way that it can penetrate between the stack end-sheet bulged out toward the side wall and the projection-free section.

11. An apparatus for processing sheet material, in particular value documents, which has a gripping device according to claim 1, wherein the gripping device is arranged to insert the gripped sheet-material stack into an input pocket of the apparatus and/or wherein the gripping device is arranged to remove the gripped sheet-material stack from an output pocket of the apparatus.

12. A method for gripping a sheet-material stack by means of a gripping device according to claim 1, for example for removing a sheet-material stack from a container, with the steps:

relatively moving the gripping elements toward each other through a relative motion of the gripping elements, in order to compress a sheet-material stack disposed between the two gripping elements and to grip it through grip-clamping, wherein at least one of the gripping fingers of the gripping elements is tilted from its starting position into its tilted position, and automatically stopping the relative motion of the gripping elements as soon as a grip-clamping is achieved, in particular as soon as an opposing force of the sheet-material stack generated upon the grip-clamping exceeds a predetermined value, and transporting the sheet-material stack gripped through the grip-clamping by means of the gripping device, wherein the grip-clamping for example removes the gripped sheet-material stack from the container.

13. The method according to claim 12, wherein after the stopping of the relative motion the relative motion of the gripping elements remains stopped for a certain waiting period, and that after the waiting period a subsequent gripping of the sheet-material stack is carried out, upon which the relative motion of the gripping elements toward each other is started anew in order to produce a reliable grip-clamping of the sheet-material stack also in the case of a relaxation of the sheet-material stack.

14. A gripping device for gripping and transporting a sheet-material stack, which has at least two gripping elements for gripping a sheet-material stack disposed between the gripping elements, which are movable toward each other in order to grip the sheet-material stack through a grip-clamping, wherein the gripping elements respectively have at least one gripping finger which can be laid against a stack end-sheet located at that end of the sheet-material stack facing the respective gripping element such that the gripping finger aereally contacts the respective stack end-sheet, wherein at least one of the gripping fingers of at least one of the gripping elements is tiltable from a starting position (A), in which the gripping finger is oriented substantially parallel to the surface of the stack end-sheet facing it, into a tilted position (K), in which the gripping finger is inclined toward the surface of the stack end-sheet facing it, wherein at least the gripping fingers of one of the gripping elements are configured for an automatic compensating motion which allows an adaptation of the position of the gripping fingers to a single non-uniform sheet-material stack, wherein the gripping fingers are fastened to the gripping element in particular in such a way that they are movable, relative to the gripping element, along the direction perpendicular to the stack surface of the sheet-material stack, into mutually different positions.

* * * * *